US006283433B1

(12) United States Patent
Lloyd-Hind

(10) Patent No.: US 6,283,433 B1
(45) Date of Patent: Sep. 4, 2001

(54) METHOD AND APPARATUS FOR MOUNTING ARTICLES

(76) Inventor: Jonathan Lloyd-Hind, 8/168 Sydney Road, Fairlight NSW (AU), 2094

( * ) Notice: Subject to any disclaimer, the term of this patent is extended or adjusted under 35 U.S.C. 154(b) by 0 days.

(21) Appl. No.: 09/165,849

(22) Filed: Oct. 2, 1998

(51) Int. Cl.[7] ..... A47B 97/04; B42D 9/00

(52) U.S. Cl. ..... 248/451; 188/264 R; 281/42

(58) Field of Search ..... 248/444.1, 451, 248/441.1, 447.2, 452, 453, 220.31; 116/234; 188/264 R; 281/45, 42, 46, 47, 48, 51; 294/151, 158

(56) References Cited

U.S. PATENT DOCUMENTS

| | | | | |
|---|---|---|---|---|
| D. 337,349 | * | 7/1993 | Woodburn | D19/32 |
| D. 346,399 | * | 4/1994 | Schad et al. | D19/34 |
| D. 380,779 | * | 7/1997 | Boshart | D19/34 |
| 1,672,113 | * | 6/1928 | Catherman | 116/234 |
| 1,736,908 | * | 11/1929 | Franey | 281/47 |
| 2,808,908 | * | 10/1957 | Lykes | 188/264 R |
| 3,298,714 | * | 1/1967 | Celmer | 281/42 |
| 3,952,989 | * | 4/1976 | Bannister Hatcher | 248/453 |
| 3,981,522 | * | 9/1976 | Bloom | 281/34 |
| 4,014,508 | * | 3/1977 | Weiss | 248/451 |
| 4,162,800 | * | 7/1979 | Gonot, Jr. et al. | 281/42 |
| 4,313,589 | * | 2/1982 | Vega | 248/558 |
| 4,375,296 | | 3/1983 | Chang | 281/45 |
| 4,512,603 | * | 4/1985 | Williams | 294/137 |
| 4,555,128 | * | 11/1985 | White et al. | 281/45 |
| 4,624,480 | * | 11/1986 | Marthaler et al. | 281/49 |
| 4,702,453 | * | 10/1987 | Bishop | 248/447.2 |
| 4,778,201 | * | 10/1988 | Kouno et al. | 281/42 |
| 5,054,816 | * | 10/1991 | Rosengarten | 281/42 |
| 5,104,167 | * | 4/1992 | Nemeth | 294/137 |
| 5,165,648 | * | 11/1992 | Quigley | 248/451 |
| 5,205,527 | * | 4/1993 | Anderson | 248/451 |
| 5,237,956 | * | 8/1993 | Igeta | 116/234 |
| 5,351,927 | * | 10/1994 | Howell | 248/444.1 |
| 5,427,414 | * | 6/1995 | Fletcher et al. | 281/42 |
| 5,622,387 | * | 4/1997 | Ordway | 281/42 |
| 5,884,889 | * | 3/1999 | Crosby | 248/460 |

FOREIGN PATENT DOCUMENTS

| | | | |
|---|---|---|---|
| 19755576 A1 | 7/1998 | (DE) . | |
| 2212443A | 7/1989 | (GB) | B43L/5/02 |
| 2294238A | 4/1996 | (GB) | B43D/9/00 |
| 09020091 | 1/1997 | (JP) . | |

* cited by examiner

*Primary Examiner*—Anita M. King
(74) *Attorney, Agent, or Firm*—Testa, Hurwitz & Thibeault, LLP

(57) ABSTRACT

The invention is an apparatus and method of fixing relatively loose multipage articles such as magazines to a back board. A band (16) is passed between pages of the article (10) and the ends (26) are secured to the front or back of a back board (12) or to themselves so as to sandwich one or more pages of the article (10) to the back board (12). The band (16) is preferably transparent so as to be unobtrusive.

20 Claims, 3 Drawing Sheets

METHOD AND APPARATUS FOR MOUNTING ARTICLES

This invention relates to the display of objects and more particularly to the display of magazines and other items with spines. However, the invention is not limited to such uses.

BACKGROUND OF THIS INVENTION

The collection of comics, newspapers and magazines as a hobby is becoming more popular. Collectors, or the casual purchaser, frequently wish to display such a magazine in a frame or the like. However, unlike canvas paintings, it is not possible to "stretch" a magazine or newspaper across a frame. Further, it is usually desired to display the entire magazine. This negates against the use of a front "mask" to sandwich the article between a front mask and a back board.

It is possible to mount the article on a backing sheet by gluing it to the backing sheet, but this is obviously an irreversible step and, generally, devalues the article.

Magazines may be mounted utilising their binding, but this leaves the free edges of the paper free to sag. Over time, the magazine sags and looses shape.

SUMMARY OF THE INVENTION

The present invention aims to overcome some of the prior art's disadvantages and so provide a method of mounting an article which provides improved display attributes and non-damaging attachment.

In preferred forms, the invention provides means and methods of mounting an article which are unobtrusive and which do not detract from the aesthetic or monetary value of the article.

In one broad form, the invention provides a backing board and a flexible band. The band is passed through the magazine, folded behind the magazine and the ends secured to the back board or to themselves, so as to sandwich at least one, but preferably more than one, page or sheet of the magazine between the band and the back board.

The band may be secured to the front surface of the back board or passed through slits above and below the article and secured to the rear surface of the back board. It is preferred to secure the band to the rear surface of the back board, since this allows for easier mounting. Alternatively, one end of the band may be secured to the front surface and the other end passed through a slit in the back board. Alternatively, the ends of the band may be passed so as to lie behind the back board and secured to themselves.

The band is preferably of a width to allow suitable pressure to be applied to the article to hold it in place without causing damage. For a normal magazine a width of about 6 to 12 centimetres is suitable.

The band is preferably a transparent plastics material, so as to be less obtrusive, but coloured bands may be used. Other materials other than plastics may be used.

The band is preferably highly resistant to "creep" or stretching, since a band that stretches or creeps over time will become loose and cease to hold the article firmly, thereby allowing sagging and damage to the article.

The ends of the band may be secured to the back board or to themselves by any suitable and appropriate means, such as by tape or glue.

Where the back board is the same height and width as the article, the band may be merely folded over the top and bottom edges of the back board and the ends secured either to themselves or to the rear of the back board.

For additional preservation 'security', a sheet of conservation plastics, such as that sold under the name Myalar, may be sandwiched between the back board and the band, or the band and the rear most page of the article, so as to avoid possible glue damage.

The invention shall be better understood from the following non-limiting description of preferred forms of the invention and the drawings.

DESCRIPTION OF THE PREFERRED EMBODIMENTS

Figure 1:
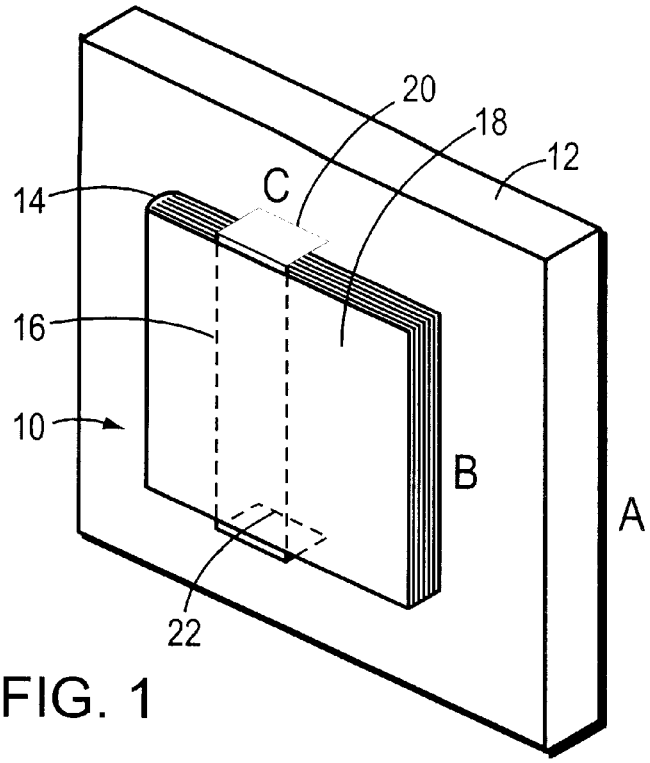
FIG. 1 is a schematic front view of a first embodiment of the invention.
Figure 2:
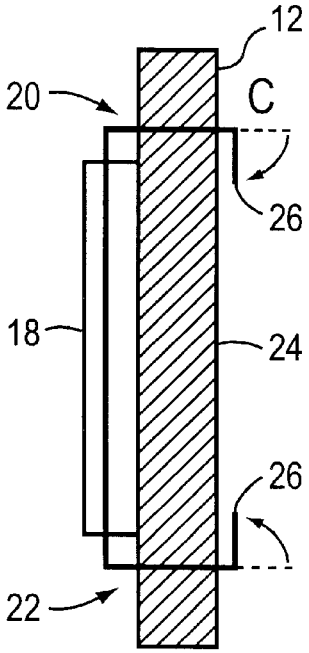
FIG. 2 is a side view of the FIG. 1 embodiment.
Figure 3:
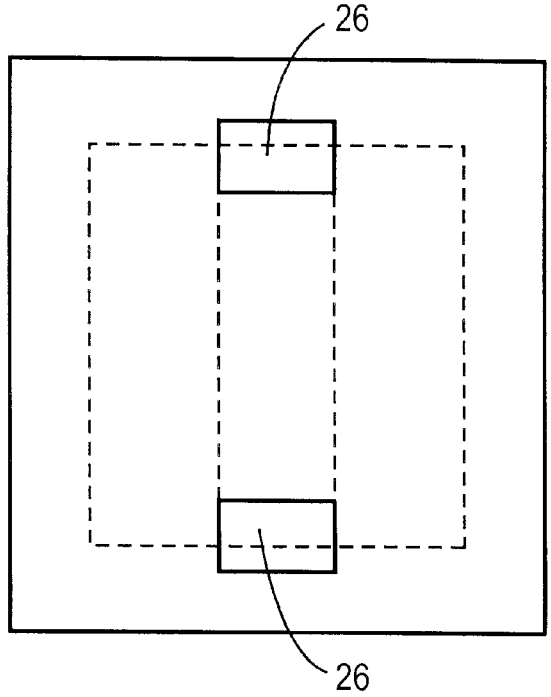
FIG. 3 is a rear view of the FIG. 1 embodiment.

Referring to FIGS. 1 to 3, there is provided an article 10 for mounting on a back board 12, which is then mounted in a display frame, not shown.

The article 10 is a magazine, comic or newspaper, or similar object which has a spine 14 at its left hand side. Typical of such articles, the spine is not usually bound, but is merely stapled or just folded sheets. As such, the spine lacks substantial rigidity. However, the technique may be applied to bound articles, such as books, which have a more rigid spine.

A band 16 is passed from top to bottom between pages of the article 10, as indicated at FIG. 2 generally, parallel to the spine 14. The band 16 may sandwich one, a small number, or all except the cover page 18 of the article 10 between itself and the back board 12. The number of pages sandwiched will depend on the quality of the paper of the article and the total size of the article 10. The band 16 is preferably a transparent plastics material about 6 to 12 centimetres wide, but other materials may be used.

Just above and below the intended position of the article 10 on the back board 12, there are provided two slits in the back board, 20, 22. The slits are substantially the same width as the band 16 and a height similar to the thickness of the band. The ends 26 of the band 16 are passed through the slits, folded against the rear surface 24 of the back board and secured to the back board. The ends 26 may be glued or taped in place, preferably with a glue or tape which over time will not "give". For best results, one end of the band is secured and then the other end tightened and then secured. Alternatively, the two ends of the band may be secured to themselves, rather than to the back board itself. This is preferably by overlapping the ends and securing them to each other with adhesive tape.

If desired, a sheet of conservation plastics material may be placed between the rear surface of the back board and the band, so as to avoid any chance of the adhesive migrating through the back board and damaging the article.

Figure 4:
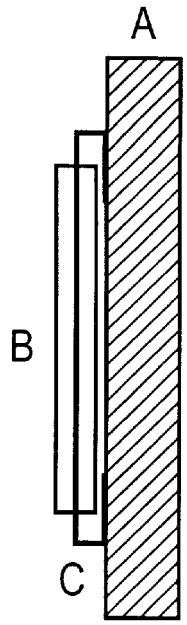
FIG. 4 is a side view of a second embodiment of the invention.

FIG. 4 shows a variation of the invention in which the band 16 does not pass through the back board. Instead, the band 16 is folded behind the article and the free ends 26 are secured, by glue or tape, to the front surface of the back board 12. This is somewhat less practical, since the band 16 must either be secured before the article is sandwiched, or there must be a small amount of slack in the fixing of the band, to allow access whilst securing it to the back board 12.

As a further alternative, one end of the band 16 may be secured to the front surface of the back board before securing the article, and the band passed through the article, a slit in the back board and secured to the rear surface of the back board. This would enable one to do away with one of the slits. Alternatively, if a back board the same size as the article is used, the band may be merely folded over the top and bottom edges of the back board and the ends secured at the rear of the back board or to themselves. By mounting an article on a back board of the same size, storage and display of the article is further enhanced—to display, the back board may be mounted in a frame, on another back board but when in storage, the frame is not needed, so reducing storage requirements.

Whilst the two embodiments utilise a band which is substantially narrower than the article being fixed, if desired or necessary, two or more discrete and generally parallel bands may be used to secure the article. Alternatively, a single band of similar width to the article may be used. As with the embodiments described, the ends of the band or bands may be secured to the front or rear surfaces of the back board or to themselves.

Figure 5A:
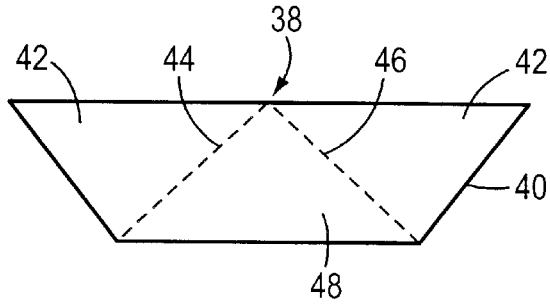
FIGS. 5*a*, 5*b* and 5*c* show perspective views of optional corner supports for use with the FIGS. 1 to 4 embodiments.
Figure 5B:
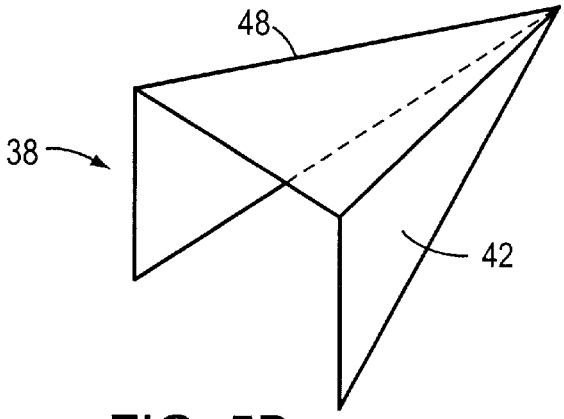
Figure 5C:
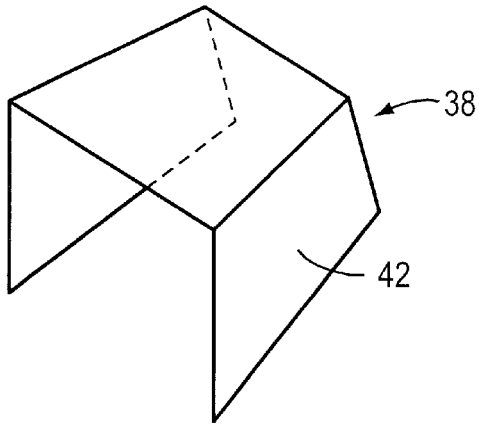
Figure 6:
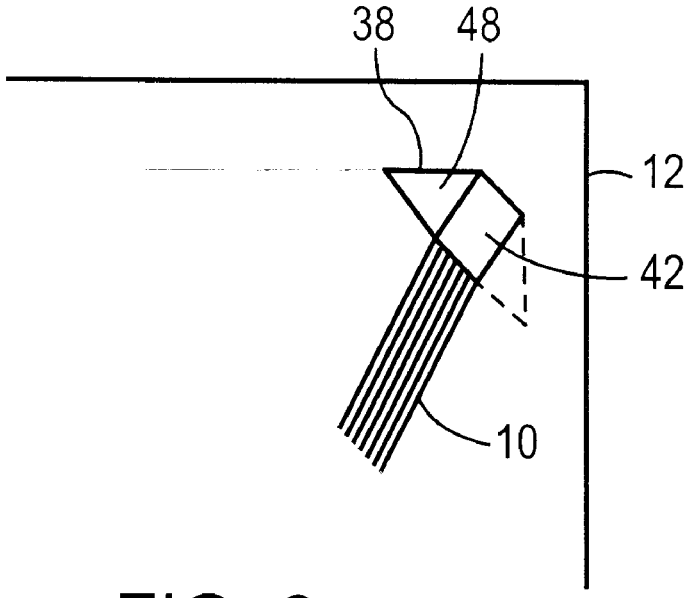
FIG. 6 shows a front perspective view of the corner supports of FIG. 5 in use.
Figure 7:
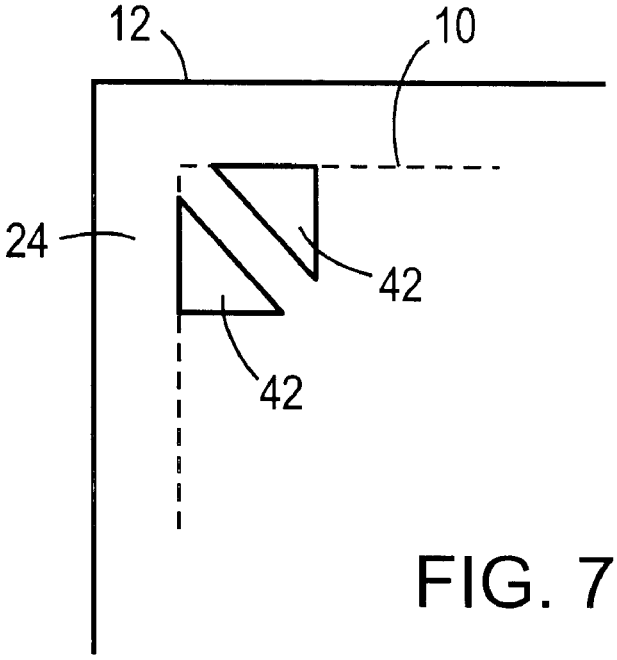
FIG. 7 shows a rear view of the corner supports in use.

Referring to FIGS. 5 to 7, these are shown optional corner supports 38. These supports 38 are utilised where the band 16 does not fully support the corners or the pages are relatively flimsy. The corner supports are also utilised to hold the front cover or page of the article tight against the back board. Where the article is mounted behind a glass or perspex protective sheet, such a protective sheet may be used to hold the front page or cover in position. However, this is not recommended, for preservation reasons.

The corner supports 38, each comprise a strip of, preferably, transparent plastics material 40, similar to that of the band 16, with the free ends 42 folded along fold lines 44, 46 relative to the centre section 48. The fold lines 44, 46 are normally at 90° to each other, but if the article has become out of shape the angle may be less than or more than 90°. The centre section 48 defined by the fold lines 44, 46 may be a triangle, as in FIG. 5*b* or a truncated triangle, as in FIG. 5*c*. In the case of FIG. 5*c*, generally the strip must be narrower or the centre section wider.

Both forms of the corner supports are used in a similar manner - the centre section 48 is placed over a corner of the article and the free ends folded to pass through slits 50 in the back board. The free ends 42 may then be folded inwards, as in FIG. 7, or outwards, and secured to the back board by way of tape or glue. The corners may be secured to themselves, instead, and as with the band, a piece of conservation plastics material may be sandwiched between the corners and the back board. As with the band, if desired, the corner supports may be secured to the front surface of the back board. Where the back board is the same size as the article, the corner supports 38 are preferably passed over the corners of both the article and back board and secured to the back board or themselves.

Whilst the invention has been described with reference to a closed magazine, it will be appreciated that it may be used with an open magazine. In that case, two bands may be passed through the magazine, one on each side of the spine.

I claim:

1. A method of securing a multipage article having a front cover to be permanently displayed and a spine to a front surface of a back board, comprising the steps of:

a) placing at least one flexible band underneath the front cover and substantially along and to one side of the spine of the article whereby a portion of the band extending underneath the front cover is hidden; and (b) securing free ends of the at least one band to sandwich at least one page of the article between the band and a front surface of the back board and allowing the front cover to be displayed free from obstructions; and (c) securing at least one corner of at least one page of the article to the back board with a respective corner support means.

2. The method of claim 1 wherein at least one of the free ends of the at least one band is secured to a rear surface of the back board.

3. The method of claim 1 wherein the back board is larger than the article and step b) includes passing at least one free end of the at least one band through a respective aperture in the back board.

4. The method of claim 3 wherein the aperture is adjacent to an edge of the article.

5. The method of claim 3 wherein the aperture has a width substantially the same as that of the respective band and a height substantially the same as the thickness of the respective band.

6. The method of claim 1 wherein the back board is a size substantially the same as the size of the article.

7. The method of claim 1 wherein at least one end of the at least one band is secured to the front surface of the back board.

8. The method of claim 1 wherein the free ends of the at least one band are secured to themselves.

9. The method of claim 1 wherein the step of securing the at least one corner comprises sandwiching a corner of all the pages of the article between the corner support means and the back board, and securing the corner support means to the back board.

10. The method of claim 1 wherein the step of securing the corner support means to the back board comprises passing one or more portions of the corner support means through an aperture in the back board.

11. The method of claim 1 wherein the free ends of the at least one band are secured to the back board.

12. A display unit comprising:

a) a multipage article having a front cover and a spine;

b) a back board;

c) at least one flexible, elongate band; wherein said at least one band is placed substantially along and to one side of the spine of the multipage article; wherein said at least one band has respective free ends to securely sandwich at least one page of the multipage article between itself and a front surface of the back board; and wherein at least the front cover of the multipage article is free of the at least one band; and d) at least one corner support unit sandwiching at least one corner of at least one page between the respective corner support unit and the back board, wherein at least part of the at least one corner support unit is attached to a rear surface of the back board.

13. The display unit of claim 12 wherein at least one free end of at least one band passes through a respective aperture in the back board.

14. The display unit of claim 12 wherein the back board is larger than the article and at least one free end of the at least one band passes through a respective aperture in the back board.

15. The display unit of claim 14 wherein the aperture is adjacent an edge of the article.

16. The display unit of claim 14 wherein the aperture has a width substantially the same as the respective band and a height substantially the same as the thickness of the respective band.

17. The display unit of claim 12 wherein the back board is a size substantially the same as the size of the article.

18. The display unit of claim 12 wherein at least one end of the at least one band is secured to the front surface of the back board.

19. The display unit of claim 12 wherein the free ends of the at least one band are secured to themselves.

20. The display unit of claim 12 wherein the free ends of the at least band are secured to the back board.

* * * * *